US008534360B2

(12) United States Patent
Kalb et al.

(10) Patent No.: US 8,534,360 B2
(45) Date of Patent: Sep. 17, 2013

(54) DEBRIS ANTI-COMPACTION SYSTEM FOR BALL VALVES

(71) Applicant: Halliburton Energy Services, Inc., Houston, TX (US)

(72) Inventors: Frank David Kalb, Lantana, TX (US); Andrew John Webber, Coppell, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/760,149

(22) Filed: Feb. 6, 2013

(65) Prior Publication Data

US 2013/0206417 A1 Aug. 15, 2013

(30) Foreign Application Priority Data

Feb. 10, 2012 (WO) ..... PCT/US2012/024707

(51) Int. Cl.
*E21B 34/06* (2006.01)

(52) U.S. Cl.
USPC ..... 166/332.3; 166/334.2; 251/208

(58) Field of Classification Search
USPC ..... 166/332.3, 334.2; 251/208
See application file for complete search history.

(56) References Cited

U.S. PATENT DOCUMENTS

| | | | | |
|---|---|---|---|---|
| 3,036,600 | A * | 5/1962 | Vickery | 137/625.12 |
| 3,398,762 | A * | 8/1968 | Fredd | 137/495 |
| 3,398,928 | A * | 8/1968 | Fredd | 251/251 |
| 3,883,113 | A * | 5/1975 | Kolb | 251/209 |
| 4,289,165 | A * | 9/1981 | Fredd | 137/625.32 |
| 4,291,722 | A * | 9/1981 | Churchman | 137/496 |
| 5,771,929 | A * | 6/1998 | Boger | 137/625.32 |
| 7,021,386 | B2 | 4/2006 | Vick | |
| 2008/0105845 | A1 | 5/2008 | Yeary | |
| 2008/0283787 | A1 | 11/2008 | Zambonin et al. | |
| 2009/0032762 | A1 | 2/2009 | Junier | |
| 2012/0260991 | A1 | 10/2012 | Inglis | |
| 2012/0273223 | A1 | 11/2012 | Aitken | |

FOREIGN PATENT DOCUMENTS

WO WO 2009/076228 6/2009

OTHER PUBLICATIONS

Authorized officer Eunju Lee, International Search Report and Written Opinion in International Application No. PCT/US2012/024707, mailed Oct. 29, 2012, 10 pages.

* cited by examiner

*Primary Examiner* — Kenneth L Thompson

(74) *Attorney, Agent, or Firm* — Scott F. Wendorf; Fish & Richardson P.C.

(57) ABSTRACT

A wellbore ball valve includes a ball-type valve closure having an interior, central bore. A lower ball carrying assembly defines a first annular, sealing seat surface in contact with and adapted to seal with the exterior of the valve closure. The first seat surface defines a first through hole. An upper assembly defines a second annular seat surface in contact with the exterior of the valve closure. The second seat surface defines a second through hole. The second through hole is shaped differently from the first through hole in that it at least partially overlaps with the central bore while the first through hole is sealed from the central bore.

17 Claims, 5 Drawing Sheets

DEBRIS ANTI-COMPACTION SYSTEM FOR BALL VALVES

BACKGROUND

This disclosure relates to valves for use in a subterranean well system.

A ball valve is a type of valve that uses a spherical ball as a closure mechanism. The ball has a hole therethrough that is aligned with the direction of flow when the valve is opened and misaligned with the direction of flow when the valve is closed. Ball valves have many applications in well tools for use downhole in a wellbore, for example, as formation tester valves, safety valves, and in other downhole applications. Many of these well tool applications use a ball valve because ball valves can have large through bore for passage of tools, tubing strings, and flow, yet also be compactly arranged, for example, having a cylindrical outer profile that corresponds to the cylindrical outer profile of the remainder of the string carrying the ball valve into the well bore and presenting few or no protrusions to hang up on the interior of the well.

SUMMARY

This disclosure describes a ball valve of a well system.

Certain aspects encompass a wellbore ball including a ball-type valve closure having an interior, central bore. A ball carrying assembly defines an annular, sealing seat surface in contact with and adapted to seal with the exterior of the valve closure. The seat surface defines a first through hole that communicates with the central bore when the valve closure is open and is sealed from the central bore when the valve closure is closed. An upper assembly defines an annular ball contacting surface in contact with the exterior of the valve closure. The ball contacting surface defines a second through hole that overlaps an opening of the central bore when the valve closure is open and does not overlap the opening of the central bore when the valve closure is closed. The second through hole is shaped differently from the first through hole in that it at least partially overlaps with the central bore while the first through hole is sealed from the central bore when the valve closure is between open and closed.

Certain aspects encompass a wellbore ball valve having a central bore. The valve as a ball and an annular sealing seat in contact with the ball. The annular sealing seat defines a first portion of the central bore. The valve has an annular ball contacting member on an opposing side of the ball from the seat. The ball contacting member defines a second portion of the central bore. The ball, seat, and annular ball contacting member are configured to, as the ball rotates from closed to open, open the interior of the ball to the second portion of the central bore before communicating the interior of the ball with the first portion of the central bore.

Certain aspects encompass a method where a central bore of a downhole tubular is sealed with a ball type valve closure. The central bore uphole of the ball type valve closure is then communicated with an interior of the ball type valve closure while sealing the interior of the ball type valve closure from the central bore downhole of the ball type valve closure.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 2A shows the example valve in an open position. FIG. 2B shows the example valve in a closed position.

FIG. 3A shows the example valve in a closed position. FIG. 3B shows the example valve between the open and closed positions. FIG. 3C shows the example valve open.

Like reference symbols in the various drawings indicate like elements.

DETAILED DESCRIPTION

This disclosure describes a ball valve in a well bore of a well system that can prevent compaction of sand-laden debris in the string from impacting and preventing the opening of a ball.

Figure 1:
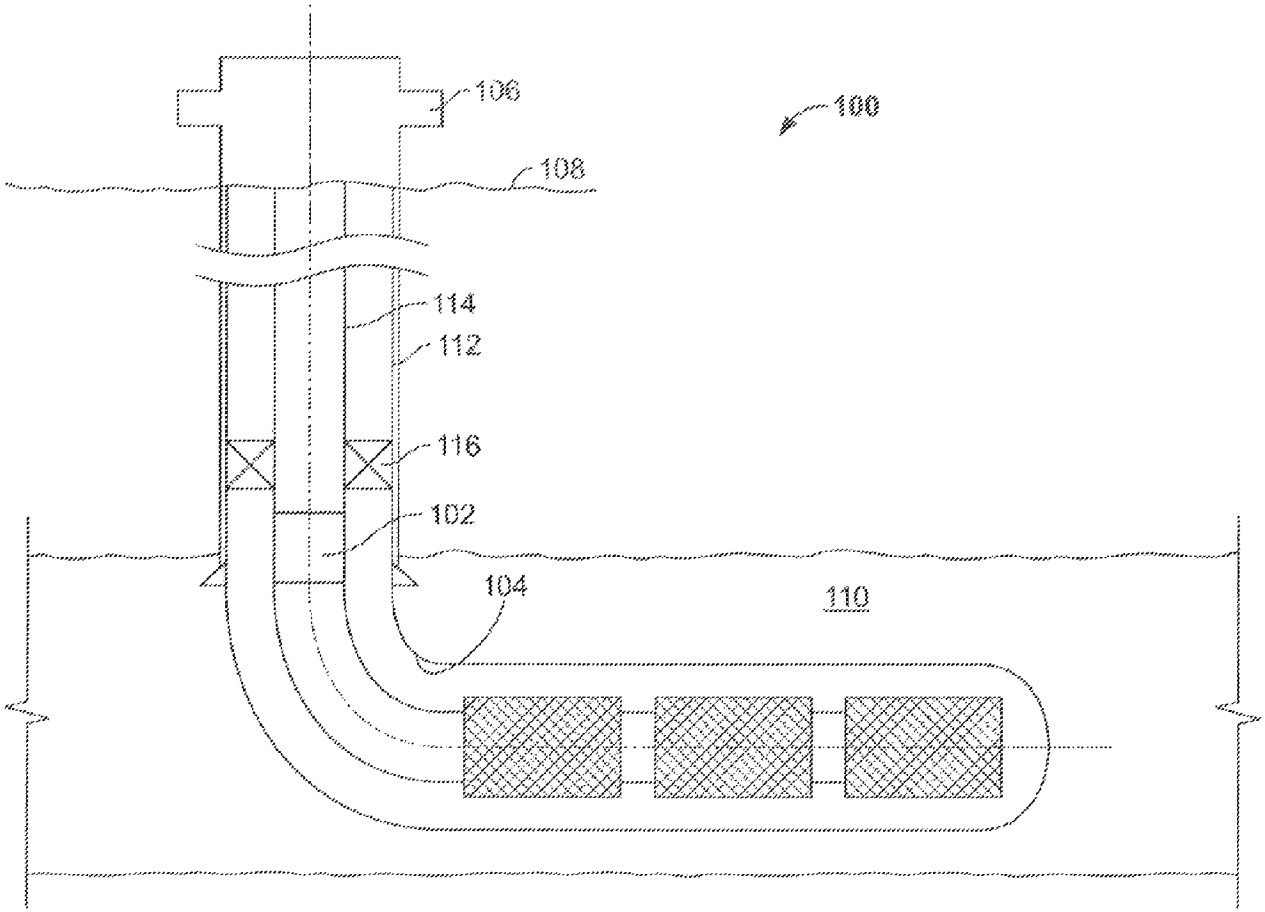
FIG. 1 is a side cross-sectional view of an example well system with a ball valve.

FIG. 1 is a side cross-sectional view of a well system 100 with an example valve 102 constructed in accordance with the concepts herein. The well system 100 is provided for convenience of reference only, and it should be appreciated that the concepts herein are applicable to a number of different configurations of well systems. As shown, the well system 100 includes a substantially cylindrical well bore 104 that extends from well head 106 at a terranean surface 108 through one or more subterranean zones of interest 110. In FIG. 1, the well bore 104 extends substantially vertically from the surface 108 and deviates to horizontal in the subterranean zone 110. However, in other instances, the well bore 104 can be of another configuration, for example, entirely substantially vertical or slanted, it can deviate in another manner than horizontal, it can be a multi-lateral, and/or it can be of another configuration.

The well bore 104 is lined with a casing 112, constructed of one or more lengths of tubing, that extends from the well head 106 at the surface 108, downhole, toward the bottom of the well 104. The casing 112 provides radial support to the well bore 104 and seals against unwanted communication of fluids between the well bore 104 and surrounding formations. Here, the casing 112 ceases at the subterranean zone 110 and the remainder of the well bore 104 is an open hole, i.e., uncased. In other instances, the casing 112 can extend to the bottom of the well bore 104 or can be provided in another configuration.

A completion string 114 of tubing and other components is coupled to the well head 106 and extends, through the well bore 104, downhole, into the subterranean zone 110. The completion string 114 is the tubing that is used, once the well is brought onto production, to produce fluids from and inject fluids into the subterranean zone 110. Prior to bringing the well onto production, the completion string is used to perform the final steps in constructing the well. The completion string 114 is shown with a packer 116 above the subterranean zone 110 that seals the annulus between the completing string 114 and casing 112, and directs fluids to flow through the completion string 114 rather than the annulus.

The example valve 102 is provided in the completion string 114 below the packer 116. The valve 102 when open, allows passage of fluid and communication of pressure through the completion string 114. When closed, the valve 102 seals against passage of fluid and communication of pressure between the lower portion of the completion string 114 below the valve 102 and the upper portion of the completion string 114. The valve 102 has provisions for both mechanical and remote operation. As described in more detail below, for mechanical operation, the valve 102 has an internal profile that can be engaged by a shifting tool to operate the valve. For remote operation, the valve 102 has a remote actuator assembly that responds to a signal (e.g., a hydraulic, electric, and/or other signal) to operate the valve. The signal can be generated remote from the valve 102, for example at the surface.

In the depicted example, the valve 102 is shown as a fluid isolation valve that is run into the well bore 104 open, mechanically closed with a shifting tool and then eventually re-opened in response to a remote signal. The valve 102, thus allows an operator to fluidically isolate the subterranean zone 110, for example, while an upper portion of the completion string 114 is being constructed, while subterranean zones above the valve 102 are being produced (e.g., in a multilateral well), and for other reasons. The concepts herein, however, are applicable to other configurations of valves. For example, the valve 102 could be configured as a safety valve. A safety valve is typically placed in the completion string 114 or riser (e.g., in a subsea well), and is biased closed and held open by a remote signal. When the remote signal is ceased, for example, due to failure of the well system above the valve 102, the valve 102 closes. Thereafter, the valve 102 is mechanically re-opened to recommence operation of the well.

Figure 2A:
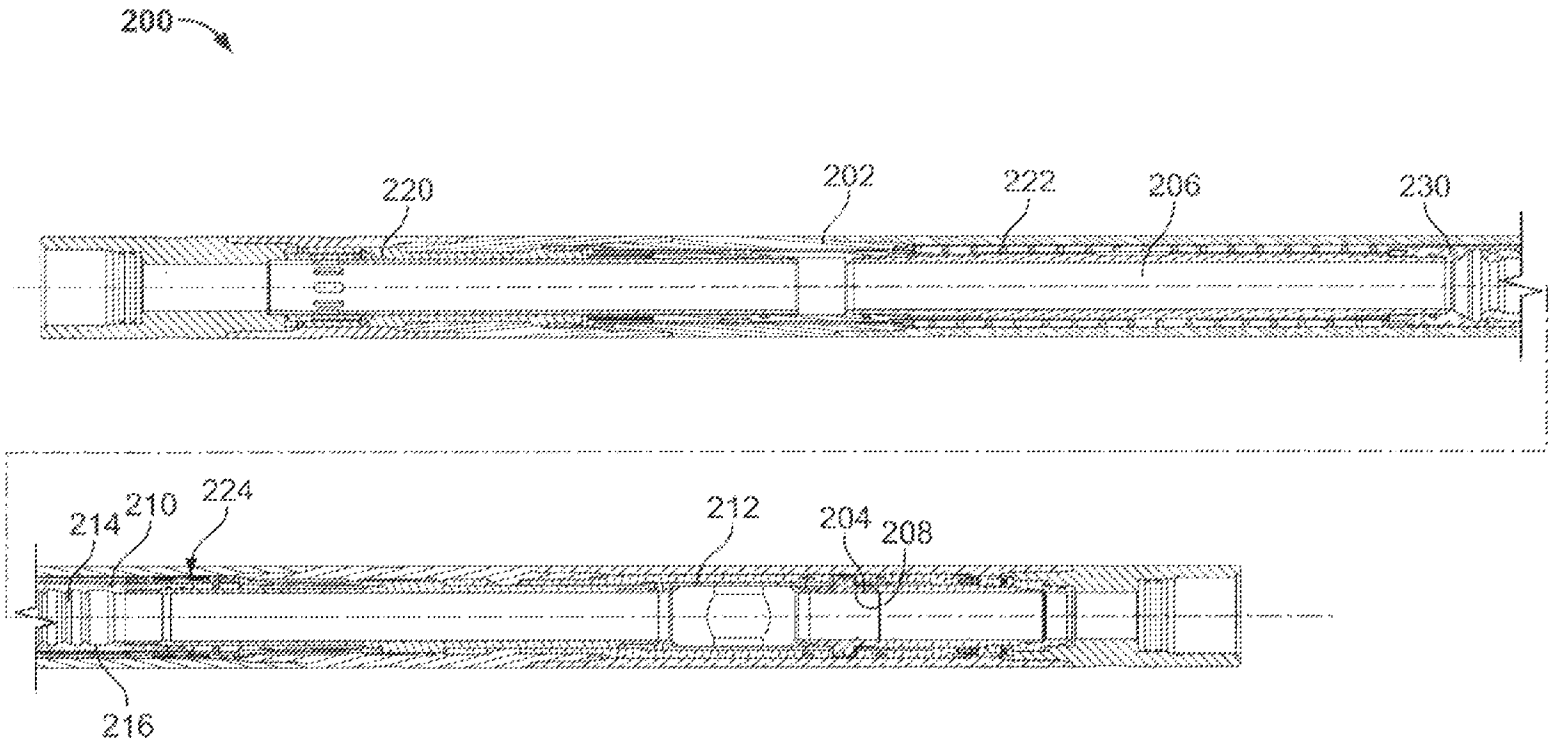
FIGS. 2A and 2B are side cross-sectional views of an example valve.
Figure 2B:
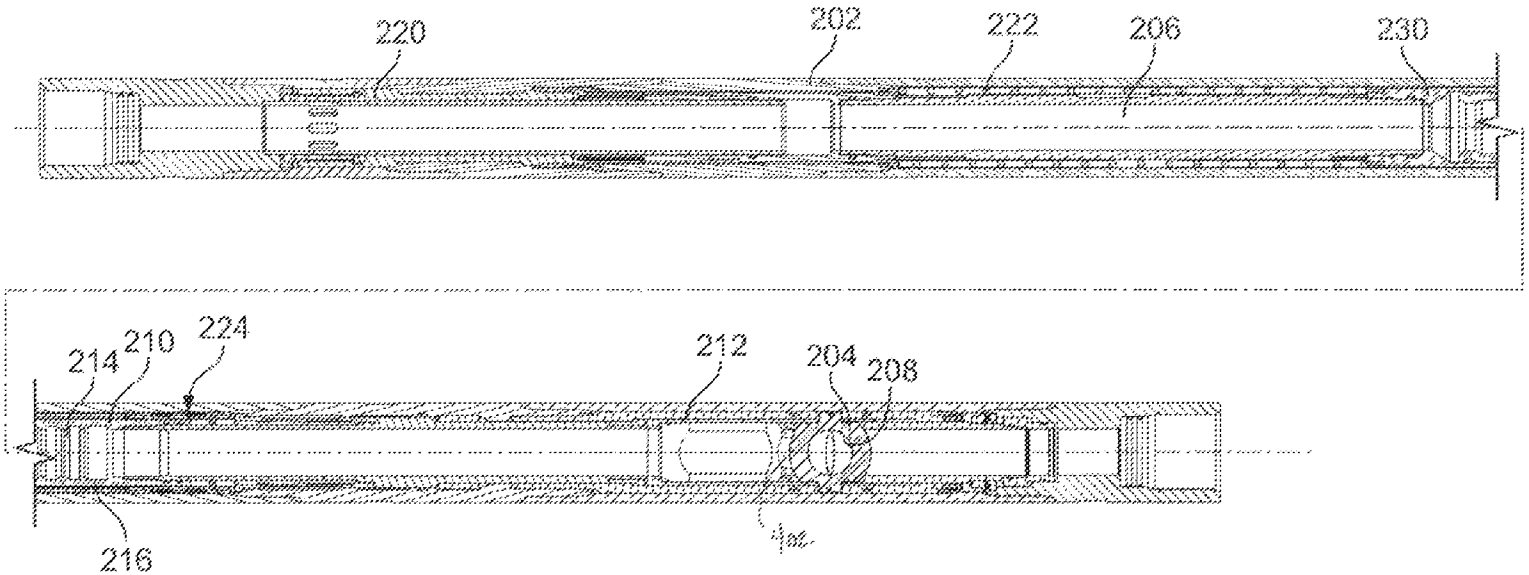

Turning now to FIGS. 2A and 2B, an example valve 200 is depicted in half side cross-section. The example valve 200 can be used as valve 102. The valve 200 includes an elongate, tubular valve housing 202 that extends the length of the valve 200. The housing 202 is shown as made up of multiple parts for convenience of construction, and in other instances, could be made of fewer or more parts. The ends of the housing 202 are configured to couple to other components of the completion string (e.g., threadingly and/or otherwise). The components of the valve 200 define an internal, cylindrical central bore 206 that extends the length of the valve 200. The housing 202 contains spherical ball-type valve closure 204 that, likewise, has a cylindrical, central bore 208 that is part of central bore 206. The central bore 206 is the largest flow bore through the valve 200. The valve closure 204 is carried to rotate about an axis transverse to the longitudinal axis of the valve housing 202. The valve 200 is open when the central bore 208 of the valve closure 204 aligns with and coincides with the central bore 206 of the remainder of the valve 200 (FIG. 2A). The valve 200 is closed when the central bore 208 of the valve closure 204 does not coincide with, and seals against passage of fluid and pressure through, the central bore 206 of the remainder of the valve 200 (FIG. 2B). In other instances, the valve closure 204 can be another type of valve closure, such as a flapper and/or other type of closure.

The valve closure 204 is coupled to an elongate, tubular actuator sleeve 210 via a valve fork 212. The actuator sleeve 210 is carried in the housing 202 to translate between an uphole position (FIG. 2B) and a downhole position (FIG. 2A), and correspondingly move the valve fork 212 between an uphole position and a downhole position. When the actuator sleeve 210 (and valve fork 212) are in the uphole position, the valve closure 204 is in the closed position. As the actuator sleeve 210 (and valve fork 212) translates to the downhole position, the valve closure 204 rotates around the transverse axis to the open position.

The valve 200 has provisions for remote operation, to operate the valve closure 204 in response to remote signal (e.g., a hydraulic, electric, and/or other signal). To this end, the valve 200 has a remote actuator assembly 220 that is coupled to the actuator sleeve 210. The actuator assembly 220 is responsive to the remote signal to shift the actuator sleeve 210 axially and change the valve between the closed and open positions. While the actuator assembly 220 can take a number of forms, depending on the desired operation of the valve, in certain instances of the valve 200 configured as a fluid isolation valve, the actuator assembly 220 is responsive to a specified number of pressure cycles (increase and decrease) provided in the central bore 208 to release compressed power spring 222 carried in the housing 202 and coupled to the actuator sleeve 210. The released power spring 222 expands and drives the actuator sleeve 210 axially from the uphole position to the downhole position, and thus changes the valve closure 204 from the closed position to the open position. In some implementations, the power spring 222 can be connected to the actuator sleeve 210 via a stop spring mandrel 230. The pressure cycles are a remote signal in that they are generated remotely from the valve 200, for example, by repeatedly opening and closing a valve in the production string at the surface, for example, in the well head. One example of such an actuator assembly can be found on the fluid loss isolation barrier valve sold under the trade name FS by Halliburton Energy Services, Inc.

The valve 102 has provisions for mechanical operation, to allow operating the valve closure 204 with a shifting tool inserted through the central bore 206. To this end, the actuator sleeve 210 has a profile 214 on its interior bore 216 that is configured to be engaged by a corresponding profile of the shifting tool. The profile 214 enables the shifting tool to grip the actuator sleeve 210 and move it between the uphole position and the downhole position, thus operating the valve closure 204 between the closed position and the open position. The shifting tool can be inserted into the valve 200 on a working string of tubing and other components inserted through the production string from the surface. One example of such an actuator sleeve and shifting tool are embodied in the fluid loss isolation barrier valve sold under the trade name FS by Halliburton Energy Services, Inc.

Figure 3A:
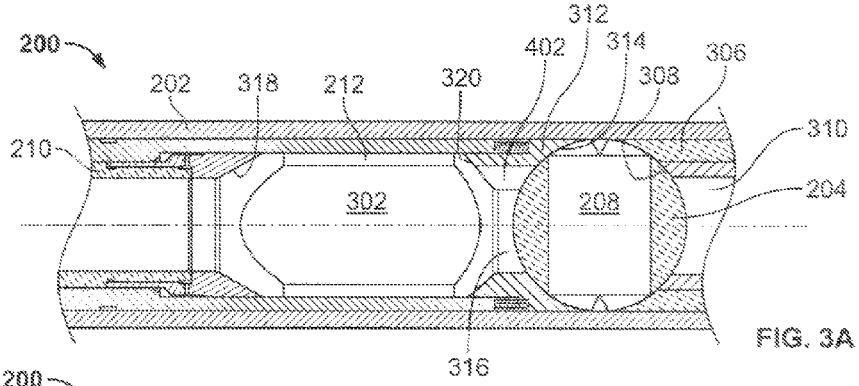
FIGS. 3A-3C are detail side cross-sectional views of the example valve of FIGS. 2A and 2B.

FIG. 3A is detail side cross-sectional view of the ball valve 200. A lower ball carrying assembly 306 defines an annular, sealing seat surface 308, which is in contact with and adapted to fluidically seal with an exterior of the valve closure 204. The seat surface 308 defines a first through hole 310 that extends the length of the lower ball carrying assembly 306. The first through hole 310 communicates with the central bore 208 when the valve closure 204 is open, and is sealed from the central bore 208 when the valve closure 204 is closed. The lower ball carrying assembly 306 can be positioned downhole relative to the closure 204. In such situations, the seat surface 308 is in contact with and adapted to seal with an exterior of a downhole end of the valve closure 204.

The components also include an upper assembly 312 that defines an annular ball contacting surface 314, which is in contact with an exterior of the valve closure 204. In certain instances, the ball contacting surface 314 can be a debris wiper surface that blocks passage of debris between the surface 314 and the exterior of the valve closure 204. In certain instances, the ball contacting surface 314 can be another sealing seat surface that fluidically seals against passage of fluid between the surface 314 and the exterior of the valve closure 204. The ball contacting surface 314 defines a second through hole 316 that extends the length of the upper assembly 312. The second through hole 316 is open to the central bore 208 when the valve closure 204 is open, and is closed off from the central bore 208 when the valve closure 204 is closed. The upper assembly 312 can be positioned uphole relative to the ball closure 204. In such situations, the ball contacting surface 314 is in contact with an exterior of an uphole end of the valve closure 204.

The fluids in the valve 200 typically also carry liquid and debris, such as sand. When the valve closure 204 is in the closed position, for example, for extended durations, the solid debris settles into a debris well 302 defined uphole of the valve closure 204. The debris well 302 encompasses an upper debris wiper 318 on the downhole face of the actuator sleeve 210 at the base of the valve fork 212, and a lower debris wiper 320 on the uphole face of the upper assembly 312. Over time, the debris/sand can become tightly compacted. In addition, a pore throat of the packed debris/sand can be become constricted to the point where fluid in the debris/sand, which would lubricate the debris/sand and help reduce grain-to-grain friction, is displaced and prevented from moving through the matrix. In other words, the debris/sand becomes dehydrated.

In some situations, the compacted, dehydrated debris/sand can prevent opening the closed valve closure 204. For example, as noted above, the actuator sleeve 210 and valve fork 212 move downhole to open the valve closure 204. In doing so, the actuator sleeve 210 and valve fork 212 move closer to the upper assembly 312, and reduce the volume of the debris well 302 in the region between the upper and lower debris wipers 318, 320. Thus, any solids in the debris well 302 between the upper and lower debris wipers 318, 320 must be displaced to allow the actuator sleeve 210 and valve fork 212 to move. If the debris/sand in the debris well 302 is compacted and/or dehydrated, downhole movement of the actuator sleeve 210 and valve fork 212 is hindered or prevented, thus hindering or preventing opening of the closed ball valve closure 204.

Figure 3B:
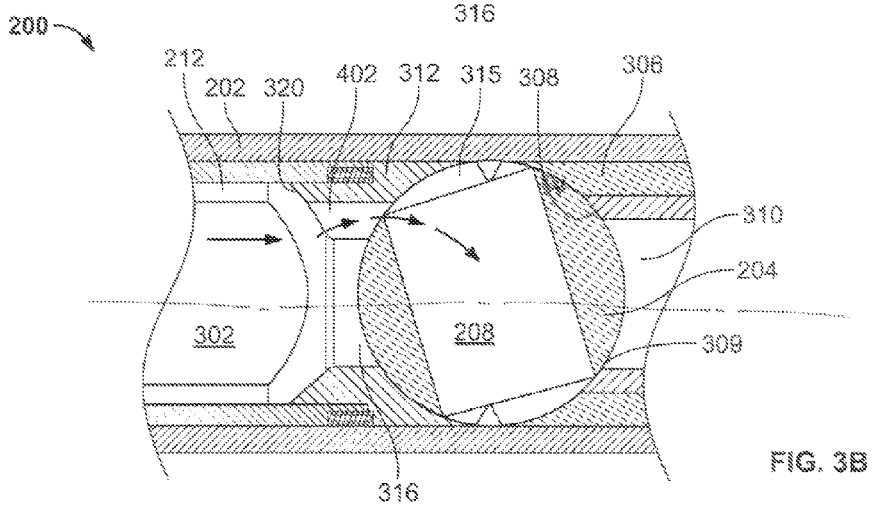
Figure 3C:
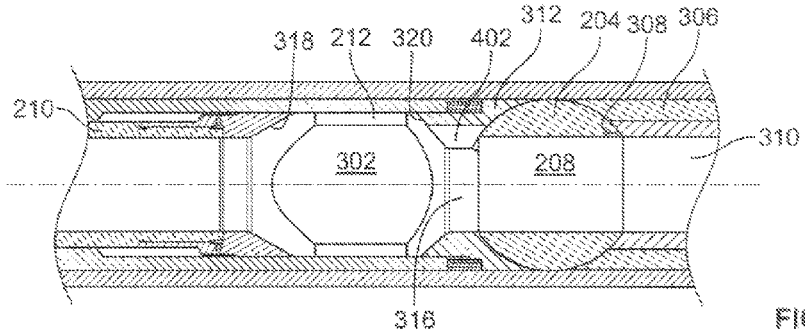

In the present example, however, the through hole 316 in the upper assembly 312 is shaped differently than the through hole 310 in the lower ball carrying assembly 306. Particularly, the through hole 310 in the upper assembly 312 is larger so that, as the ball valve closure 204 is initially rotated toward open and is between open and closed, it opens the debris well 302 to the central bore 208 of the ball valve closure 204 while the through hole 310 in the lower ball carrying assembly 306 continues to seal the central bore 208. FIG. 3A shows the ball valve closure 204 closed and sealed at the perimeter of the through hole 316 and 310. The through holes 316 and 310 do not overlap the central bore 208. FIG. 3B shows the ball valve closure 204 initially rotated toward open, but between open and closed, with the bore 208 breaching the through hole 316 at opening 315. The ball valve closure 204, however, remains sealed at location 309 because the bore 208 has not breached (i.e., does not overlap with) the hole 310. Finally, in FIG. 3C, the ball valve closure 204 is fully open, and the bore 208 fully overlaps with the through holes 310, 316.

Initially opening the central bore 208 of the ball valve closure 204 provides a nearby volume, i.e., the central bore 208, for the debris/sand to displace into. Additionally, the ball valve closure 204 usually retains some fluid in the bore 208 when closed. As the ball valve closure 204 initially opens to the debris well 302, the retained fluid remains in the bore 208 until the bore 208 breaches the through hole 310 in the lower ball carrying assembly 306. The debris/sand in the debris well 302 contacts the retained fluid, and is locally wetted near the hole 310 in the upper assembly 312. Wetting the debris/sand increases its fluidity and ability to displace into the newly opened volume of the bore 208. The debris/sand that flows into the bore 208, in turn, frees up volume in the debris well 302 for the remaining debris/sand to loosen and displace from the volume between the actuator sleeve 210/valve fork 212 and the upper assembly 312 (i.e., between the upper and lower debris wipers 318, 320), thus freeing the actuator sleeve 210/valve fork 212 to move downhole and the ball valve closure 204 to fully open.

Figure 4A:
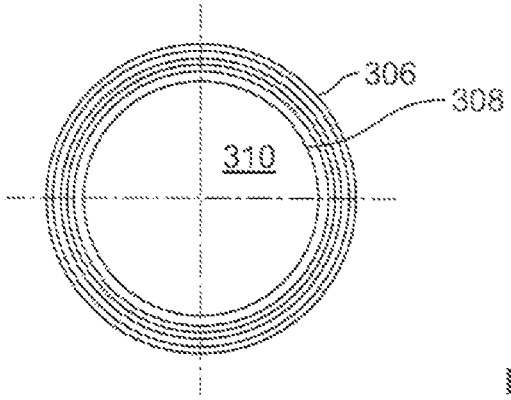
FIGS. 4A-4C show end views of the lower ball carrying assembly, the ball-type valve closure, and the upper assembly respectively.
Figure 4B:
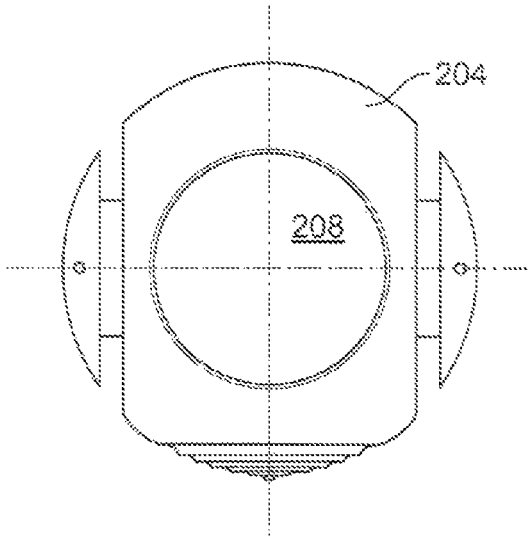
Figure 4C:
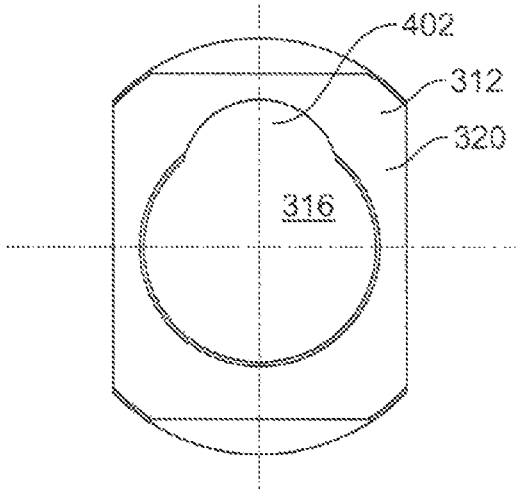

FIGS. 4A, 4B, and 4C are cross-sectional views of the through hole 310 in the lower ball carrying assembly 306, the central bore 208 in the valve closure 204, and the through hole 316 in the upper assembly 312, respectively. As shown in FIGS. 4A and 4B, the inner diameter (and consequently the area) of the through hole 310 in the lower ball carrying assembly 306 is substantially the same as the inner diameter (and the area) of the central bore 208. The area of the through hole 316 in the upper assembly 312, on the other hand, is larger than each of the through hole 310 in the lower ball carrying assembly 306 and the central bore 208. In the depicted example, the through hole 310 in the lower ball carrying assembly 306 is substantially circular, and the through hole 316 in the upper assembly 306 has a substantially circular portion with an extension portion 402 protruding from a side of the substantially circular portion. A greatest dimension of the through hole 316 measured along or parallel to the direction of rotation of the ball valve closure 204 is larger than a greatest dimension of the through hole 316 measured transverse to the direction of rotation or a greatest dimension of the through hole 310. For example, the extension portion 402 can be a circular sector of smaller radius than the radius of the remaining through hole 316. The extension portion 402 can protrude from the substantially circular shape of the remaining through hole 316 and extend against and parallel (substantially or precisely) to the direction of rotation of the ball valve closure when it is moved from closed to open. If a circular sector, the radius of the circle can be selected to substantially match the radius of a projection of the central bore on the upper assembly 306. However, the extension portion 402 need not be a circular sector, and can have another, non-arced shape. The extension portion 402 is small enough that when the central axis of the central bore is perpendicular to the central axis of the valve 200, the ball valve closure is sealed.

While this specification contains many specific implementation details, these should not be construed as limitations on the scope of any implementations or of what may be claimed, but rather as descriptions of features specific to particular implementations. Thus, particular implementations of the subject matter have been described. Other implementations are within the scope of the following claims.

What is claimed is:

1. A wellbore ball valve, comprising:

a ball-type valve closure having an interior, central bore;

a ball carrying assembly defining an annular, sealing seat surface in contact with and adapted to seal with the exterior of the valve closure, the seat surface defining a first through hole that communicates with the central bore when the valve closure is open and is sealed from the central bore when the valve closure is closed;

an upper assembly defining an annular ball contacting surface in contact with the exterior of the valve closure, the ball contacting surface defining a second through hole that overlaps an opening of the central bore when the valve closure is open and does not overlap the opening of the central bore when the valve closure is closed, the second through hole being shaped differently from the first through hole in that it at least partially overlaps with the central bore while the first through hole is sealed from the central bore when the valve closure is between open and closed; and the second through hole being larger than the first through hole, and the valve closure rotating in a first direction when changed from closed to open and the second through hole being larger in a greatest dimension measured parallel to the first direction than a greatest dimension measured transverse to the first direction.

2. The ball valve of claim 1, where the second through hole is the smallest flow area through hole adjacent the valve closure.

3. The ball valve of claim 1, where the second through hole is larger than the first through hole.

4. The ball valve of claim 1, where the first through hole is substantially circular and the second through hole comprises a substantially circular portion with an extension portion protruding from a side of the substantially circular portion.

5. The ball valve of claim 4, where the valve closure rotates in a first direction when changed from closed to open, and the extension portion extends from the substantially circular portion opposite the first direction.

6. The ball valve of claim 5, where the extension portion of the second through hole communicates with an uphole end of the central bore while a downhole end of the central bore is sealed from the first through hole when the valve closure is adjusted from closed to open.

7. The ball valve of claim 1, where the ball carrying assembly is downhole relative to the valve closure, and the upper assembly is uphole relative to the valve closure.

8. The ball valve of claim 1, where a greatest transverse dimension of the second through hole is greater than a corresponding greatest dimension of the first through hole.

9. A ball valve for use in a well, the valve having a central bore, the valve comprising:

a ball;

an annular sealing seat in contact with the ball and defining a first portion of the central bore;

an annular ball contacting member on an opposing side of the ball and defining a second portion of the central bore, the ball, seat, and annular ball contacting member configured to, as the ball rotates from closed to open, open the interior of the ball to the second portion of the central bore before communicating the interior of the ball with the first portion of the central bore;

the annular sealing seat having a central through hole that is smaller than a central through hole of the ball contacting member; and the annular ball rotating from closed to open and the central through hole of the ball contacting member having a larger greatest dimension measured parallel to the direction of rotation than a greatest dimension measured transverse to the direction of rotation.

10. The ball valve of claim 9, where the ball, the seat, and the annular ball contacting member are configured to open the interior of the ball to the second portion of the central bore while the interior of the ball is sealed from the first portion of the central bore.

11. The ball valve of claim 9, where the ball is between fully open and fully closed when the interior of the ball is open to the second portion of the central bore and before communicating the interior of the ball with the first portion of the central bore.

12. The ball valve of claim 11, where when the ball is fully open, the interior of the ball is open to the first and second portions of the central bore; and where when the ball is fully closed, the interior of the ball is closed off from the second portion of the central bore and sealed from the first portion of the central bore.

13. The ball valve of claim 9, where the seat is toward a downhole end of the valve and the ball contacting member is toward an uphole end of the valve.

14. The ball valve of claim 9, where the seat has a central through hole that is a different shape than a central through hole of the ball contacting member.

15. A wellbore ball valve, comprising:

a ball-type valve closure having an interior, central bore;

a ball carrying assembly defining an annular, sealing seat surface in contact with and adapted to seal with the exterior of the valve closure, the seat surface defining a first through hole that communicates with the central bore when the valve closure is open and is sealed from the central bore when the valve closure is closed; and an upper assembly defining an annular ball contacting surface in contact with the exterior of the valve closure, the ball contacting surface defining a second through hole that overlaps an opening of the central bore when the valve closure is open and does not overlap the opening of the central bore when the valve closure is closed, the second through hole being shaped differently from the first through hole in that it at least partially overlaps with the central bore while the first through hole is sealed from the central bore when the valve closure is between open and closed, and the first through hole is substantially circular and the second through hole comprises a substantially circular portion with an extension portion protruding from a side of the substantially circular portion.

16. The ball valve of claim 15, where the valve closure rotates in a first direction when changed from closed to open, and the extension portion extends from the substantially circular portion opposite the first direction.

17. The ball valve of claim 16, where the extension portion of the second through hole communicates with an uphole end of the central bore while a downhole end of the central bore is sealed from the first through hole when the valve closure is adjusted from closed to open.

* * * * *